US009825396B2

(12) United States Patent
Besser et al.

(10) Patent No.: US 9,825,396 B2
(45) Date of Patent: Nov. 21, 2017

(54) ELECTRICAL CONNECTOR WITH MALE BLADE TERMINAL PROTECTOR

(71) Applicant: YAZAKI NORTH AMERICA, INC., Canton, MI (US)

(72) Inventors: Joseph Paul Besser, Royal Oak, MI (US); Jen Vun Ng, Westland, MI (US)

(73) Assignee: YAZAKI NORTH AMERICA, INC., Canton, MI (US)

( * ) Notice: Subject to any disclaimer, the term of this patent is extended or adjusted under 35 U.S.C. 154(b) by 0 days.

(21) Appl. No.: 15/484,775

(22) Filed: Apr. 11, 2017

(65) Prior Publication Data

US 2017/0294733 A1 Oct. 12, 2017

Related U.S. Application Data

(60) Provisional application No. 62/321,614, filed on Apr. 12, 2016.

(51) Int. Cl.
*H01R 13/453* (2006.01)
*H01R 13/631* (2006.01)

(52) U.S. Cl.
CPC ..... *H01R 13/4538* (2013.01); *H01R 13/631* (2013.01)

(58) Field of Classification Search
CPC ..... H01R 13/4538; H01R 13/631
USPC ..... 439/140
See application file for complete search history.

(56) References Cited

U.S. PATENT DOCUMENTS

| | | | | |
|---|---|---|---|---|
| 5,437,558 | A * | 8/1995 | Sakuraoka | H01R 12/7005 439/140 |
| 6,176,712 | B1 * | 1/2001 | Huang | H01R 13/4538 439/140 |
| 6,692,274 | B2 | 2/2004 | Maegawa | |
| 6,761,568 | B2 | 7/2004 | Bakker et al. | |
| 7,134,901 | B2 * | 11/2006 | Okura | H01R 13/4538 439/140 |
| 7,267,562 | B2 * | 9/2007 | Katsuma | H01R 13/4538 439/140 |

(Continued)

FOREIGN PATENT DOCUMENTS

| | | |
|---|---|---|
| EP | 1 672 747 | 6/2006 |
| EP | 1 443 607 B1 | 9/2009 |

(Continued)

*Primary Examiner* — Tulsidas C Patel
*Assistant Examiner* — Travis Chambers
(74) *Attorney, Agent, or Firm* — Foley & Lardner LLP

(57) ABSTRACT

An electrical connector can include a male blade terminal protector that protects one or more male blade terminals from external objects before, during, and after coupling of the male connector to a female connector. The male blade terminal protector can be slidably disposed within a housing of the male connector and configured to retract when the female connector is coupled to the male connector and extend when the female connector is decoupled from the male connector. The male blade terminal protector is moveable from an extended position to a retracted position when a ledge is disengage from a catch by a ramped surface of a female housing and a retraction tab of the female housing is configured to move the male blade terminal protector from the retracted position to the extended position as the female connector is disengaged from the male connector.

20 Claims, 3 Drawing Sheets

(56) References Cited

U.S. PATENT DOCUMENTS

| | | | | |
|---|---|---|---|---|
| 7,427,205 | B2 | 9/2008 | Sasaki et al. | |
| 7,549,887 | B1 | 6/2009 | Ng et al. | |
| 7,588,455 | B2 * | 9/2009 | Matsumura | H01R 13/631 439/357 |
| 7,670,177 | B2 * | 3/2010 | Myer | H01R 13/4365 439/595 |
| 8,147,261 | B2 * | 4/2012 | Horiuchi | H01R 13/514 439/157 |
| 2003/0003786 | A1 | 1/2003 | Bakker et al. | |
| 2006/0205264 | A1 * | 9/2006 | Katsuma | H01R 13/4538 439/381 |
| 2015/0333431 | A1 | 11/2015 | Gerwatowski et al. | |
| 2015/0380857 | A1 | 12/2015 | Mingo et al. | |

FOREIGN PATENT DOCUMENTS

| | | | |
|---|---|---|---|
| EP | 2 448 068 | A1 | 5/2012 |
| EP | 2 772 993 | A1 | 9/2014 |
| JP | 5009538 | | 8/2012 |
| WO | WO-2010/015891 | | 2/2010 |

* cited by examiner

ELECTRICAL CONNECTOR WITH MALE BLADE TERMINAL PROTECTOR

CROSS-REFERENCE TO RELATED APPLICATIONS

This application claims the benefit of and priority to U.S. Provisional Application No. 62/321,614, filed Apr. 12, 2016, which is incorporated by reference herein in its entirety.

TECHNICAL FIELD

The present application relates generally to the field of electrical wiring connectors, and more particularly to a connector having a selectively engageable male blade terminal protector.

BACKGROUND

Electrical connectors can be used to couple, join or electrically connect various electrical components together to enable data, current, etc. to flow between the electrical components. For example, an electrical component can include one or more electrical wires, which can be joined together at a terminal. The terminal can be configured to mate with a corresponding terminal, in a male-to-female fashion. A male blade terminal is inserted into a female receptacle terminal to electrically couple the male connector to the female connector. In some instances, in-line electrical connectors can be used in motor vehicles due to their compact size. An in-line connector can include a male connector having a male housing that surrounds one or more male blade terminals, and a female connector having a female housing that surrounds one or more female receptacle terminals. When the female connector is coupled to the male connector, the male blade terminals are positioned within the female receptacle terminals, thereby limiting any exposure to external objects, such as fingers and/or other external objects that may contact the male blade terminals. However, when the male connector is not coupled to the female connector, the male blade terminals may be exposed to external objects. Such exposure may result in bending, breaking, or other damage to the male blade terminals, thereby potentially affecting operation of the connector.

SUMMARY

Implementations described herein relate to systems and methods for protecting one or more male blade terminals of a connector from external objects (e.g., fingers, debris, etc.) before, during, and after coupling of the male connector to a female connector. The male blade terminal protector can be slidably disposed within a housing of the male connector and configured to retract when the female connector is coupled to the male connector and extend when the female connector is decoupled from the male connector.

One implementation relates to a connector assembly that includes a male connector and a female connector. The male connector includes a male housing that includes one or more male blade terminals, a male blade terminal protector, and a catch. The male blade terminal protector is moveable from an extended position relative to the male housing to a retracted position relative to the male housing. The male blade terminal protector includes one or more openings through which each of the one or more male blade terminals extend when the male blade terminal protector is in the retracted position. The male blade terminal protector covers the one or more male blade terminals when the male blade terminal protector is in the extended position. The male blade terminal protector also includes a ledge and a retraction opening. The catch engages the ledge of the male blade terminal protector to restrict the male blade terminal protector from moving longitudinally relative to the male housing from the extended position to the retracted position. The female connector is configured to selectively engage with the male connector and includes a female housing complementary to the male housing of the male connector. The female housing includes one or more female terminals each configured to electrically couple to a corresponding male blade terminal of the one or more male blade terminals. The female housing also includes a ramped surface configured to contact a surface of the ledge of the male blade terminal protector to disengage the ledge from the catch of the male housing when the female connector is coupled to the male connector. The female housing further includes a retraction tab configured to couple to the male blade terminal protector when the retraction tab inserts into the retraction opening of the male blade terminal protector. The male blade terminal protector is moveable from the extended position to the retracted position when the ledge is disengage from the catch by the ramped surface of the female housing and the retraction tab of the female housing is configured to move the male blade terminal protector from the retracted position to the extended position as the female connector is disengaged from the male connector.

In some implementations, the retraction tab is configured to resiliently deform a portion of the male blade terminal protector that includes the retraction opening for the retraction tab to insert into the retraction opening. In some implementations, the retraction tab includes a first ramped surface to contact and resiliently deform the portion of the male blade terminal protector to insert the retraction tab into the retraction opening when the female connector is initially engaged with the male connector. In some implementations, the retraction tab includes a second ramped surface to contact and resiliently deform the portion of the male blade terminal protector to decouple the retraction tab from the retraction opening when the female connector is disengaged from the male connector. In some implementations, the ramped surface of the female housing resiliently deforms a support arm connected to and supporting the ledge such that the ledge is pushed up and over the catch of the male housing when the female connector is initially engaged with the male connector. In some implementations, the male housing includes a tab and the male blade terminal protector includes a slot, the tab engaging an end of the slot of the male blade terminal protector to restrict the male blade terminal protector from moving longitudinally away from the male housing beyond the retracted position. In some implementations, the male housing includes one or more retention features configured to resiliently deform a portion of the female housing of the female connector and insert into a retention opening of the female housing when the male housing is initially inserted into the female housing. In some implementations, the male housing includes one or more alignment features. In some implementations, the female housing covers the one or more male blade terminals when the male blade terminal protector is moved from the extended position to the retracted position. In some implementations, the male housing and the female housing include an electrically insulative material.

Another implementation relates to a connector assembly that includes a male connector and a female connector. The male connector includes a male housing that includes one or more male blade terminals, a male blade terminal protector, and a catch. The male blade terminal protector is moveable from an extended position relative to the male housing to a retracted position relative to the male housing. The male blade terminal protector covers the one or more male blade terminals when the male blade terminal protector is in the extended position. The male blade terminal protector also includes a ledge and a retraction opening. The catch engages the ledge of the male blade terminal protector to restrict the male blade terminal protector from moving longitudinally relative to the male housing from the extended position to the retracted position. The female connector is configured to selectively engage with the male connector and includes a female housing complementary to the male housing of the male connector. The female housing includes one or more female terminals each configured to electrically couple to a corresponding male blade terminal of the one or more male blade terminals. The female housing also includes a surface configured to contact the ledge of the male blade terminal protector to disengage the ledge from the catch of the male housing when the female connector is coupled to the male connector. The female housing further includes a retraction tab configured to couple to the male blade terminal protector when the retraction tab inserts into the retraction opening of the male blade terminal protector. The male blade terminal protector is moveable from the extended position to the retracted position when the ledge is disengage from the catch by the surface of the female housing and the retraction tab of the female housing is configured to move the male blade terminal protector from the retracted position to the extended position as the female connector is disengaged from the male connector.

In some implementations, the retraction tab includes a first ramped surface to contact and resiliently deform a portion of the male blade terminal protector to insert the retraction tab into the retraction opening when the female connector is initially engaged with the male connector. In some implementations, wherein the retraction tab includes a second ramped surface to contact and resiliently deform the portion of the male blade terminal protector to decouple the retraction tab from the retraction opening when the female connector is disengaged from the male connector. In some implementations, the ramped surface of the female housing resiliently deforms a support arm connected to and supporting the ledge such that the ledge is pushed up and over the catch of the male housing when the female connector is initially engaged with the male connector. In some implementations, the male housing includes a tab and the male blade terminal protector includes a slot, the tab engaging an end of the slot of the male blade terminal protector to restrict the male blade terminal protector from moving longitudinally away from the male housing beyond the retracted position. In some implementations, the male housing includes one or more alignment features.

Yet a further implementation relates to a connector that includes a male housing, one or more male blade terminals, a male blade terminal protector, and a catch. The male blade terminal protector is moveable from an extended position relative to the male housing to a retracted position relative to the male housing. The male blade terminal protector includes one or more openings through which each of the one or more male blade terminals extend when the male blade terminal protector is in the retracted position. The male blade terminal protector also covers the one or more male blade terminals when the male blade terminal protector is in the extended position, and the male blade terminal protector including a ledge and a retraction opening. The catch engages the ledge of the male blade terminal protector to restrict the male blade terminal protector from moving longitudinally relative to the male housing from the extended position to the retracted position. The male blade terminal protector is moveable from the extended position to the retracted position when the ledge is disengage from the catch by a surface of a female housing when a female connector is initially engaged with the connector, and a retraction tab of the female housing is configured to couple to and move the male blade terminal protector from the retracted position to the extended position as the female connector is disengaged from the connector.

In some implementations, a portion of the male blade terminal protector is resiliently deformed by a first ramped surface of the retraction tab to insert the retraction tab into a retraction opening formed in the male blade terminal protector when the female connector is initially engaged with the connector. In some implementations, the portion of the male blade terminal protector is resiliently deformed by a second ramped surface of the retraction tab to decouple the retraction tab from the retraction opening when the female connector is disengaged from the connector. In some implementations, a support arm connected to and supporting the ledge is resiliently deformed by the surface of the female housing such that the ledge is pushed up and over the catch of the male housing when the female connector is initially engaged with the male connector.

BRIEF DESCRIPTION

The details of one or more implementations are set forth in the accompanying drawings and the description below. Other features, aspects, and advantages of the disclosure will become apparent from the description, the drawings, and the claims, in which:

Figure 3:
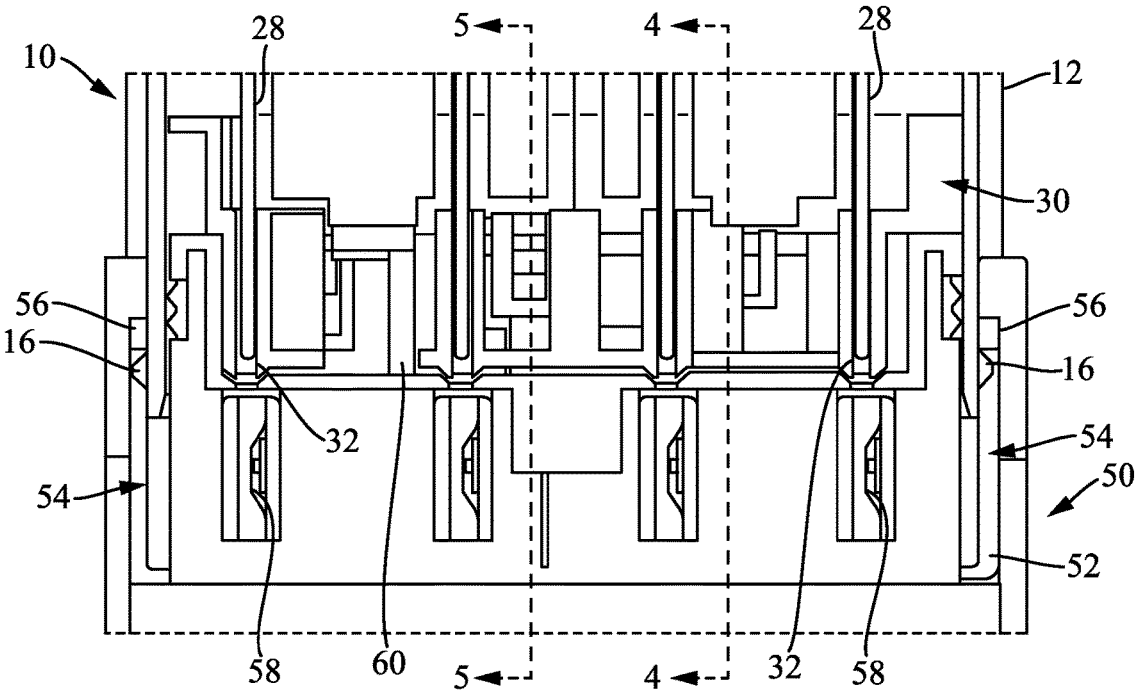
FIG. 3 is a top cross-sectional view of the male connector with retention features of the housing engaging an inner feature of a housing of a female connector when the female connector is initially coupled to the male connector.
Figure 5:
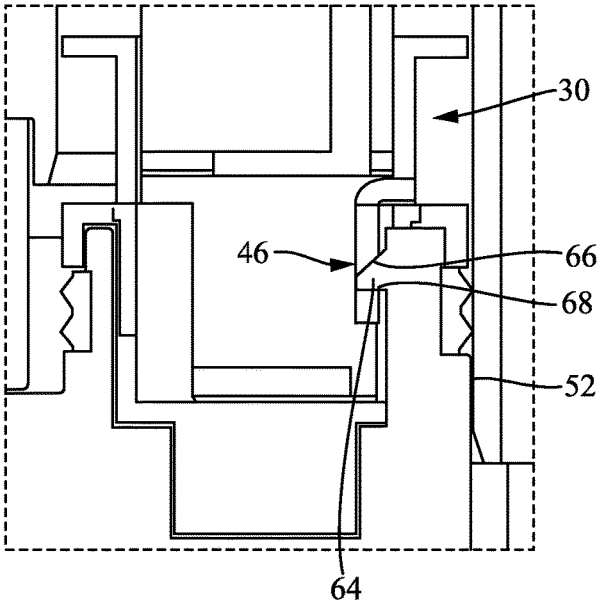
Figure 6:
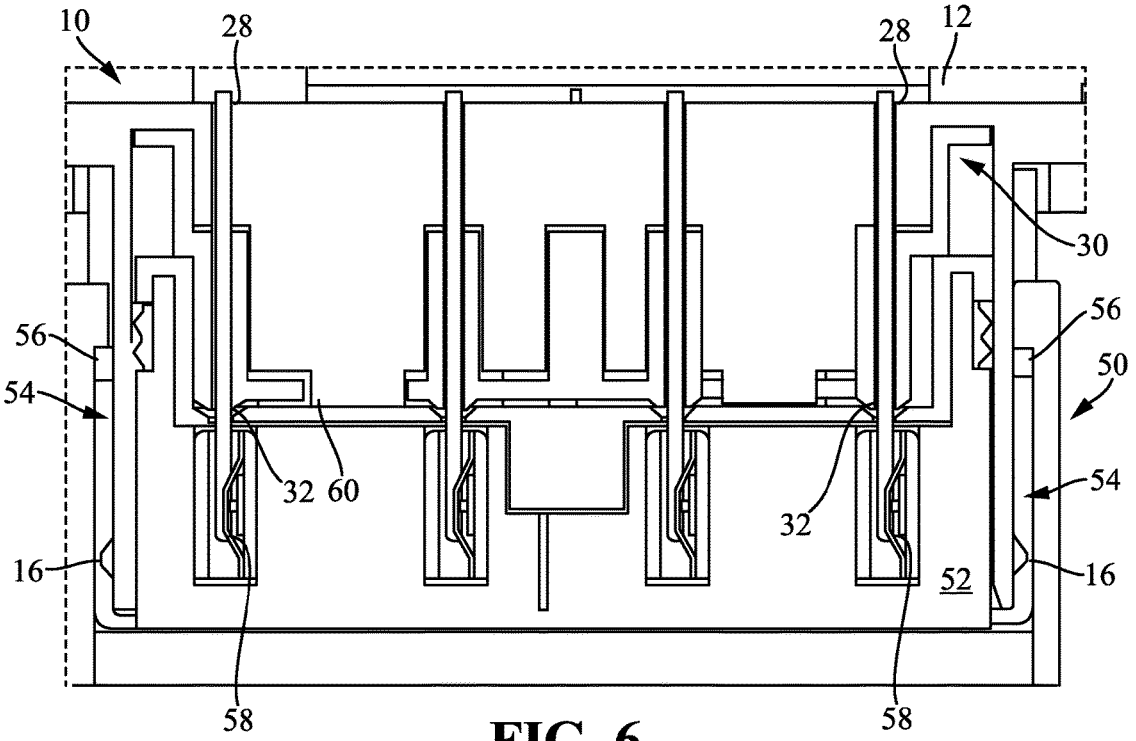

FIG. 5 is a side cross-sectional view of a portion of the male connector taken along line 5-5 of FIG. 3 and showing a retention feature of the housing of the female connector inserted into an opening of the male blade terminal protector to couple the female housing to the male blade terminal protector; and FIG. 6 is a top cross-sectional view of the male connector coupled to and fully seated with the female connector.

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and systems for protecting one or more male blade terminals of a connector from external objects before, during, and after coupling of a male connector to a female connector. The various concepts introduced above and discussed in greater detail below may be implemented in any of numerous ways, as the described concepts are not limited to any particular manner of implementation. Examples of specific implementations and applications are provided primarily for illustrative purposes.

Figure 1:
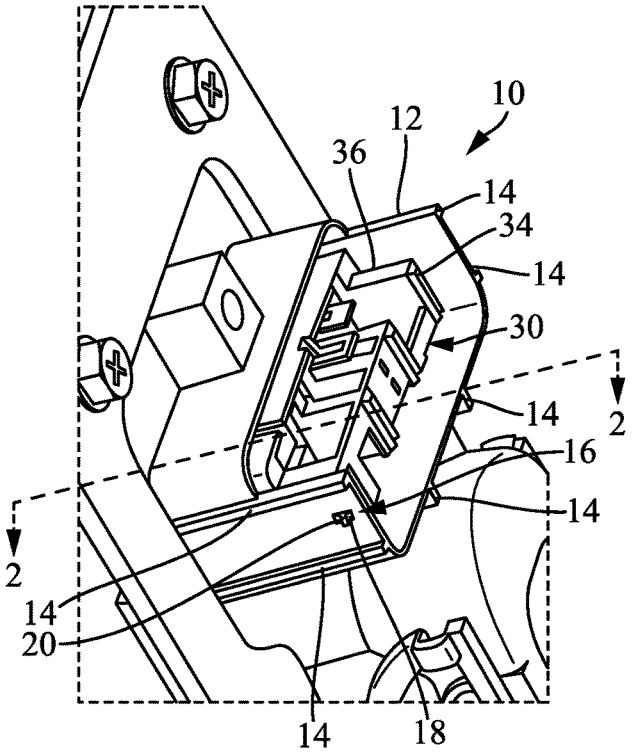
FIG. 1 is a perspective view of a male connector having a male blade terminal protector shown in an extended position to protect one or more male blade terminals while a female connector is not coupled to the male connector.

FIG. 1 depicts an example male connector 10 of a connector assembly that includes a male housing 12 configured to couple to a complementary female housing 52 of a female connector 50 (shown in FIG. 3) of the connector assembly. In some implementations, the male connector 10 may be formed as part of or electrically coupled to wires of a battery. In other implementations, the male connector 10 may be electrically coupled to other electronic components. The male housing 12 can be composed of a suitable electrically insulative material, such as a polymer, and can be manufactured through any suitable technique, such as injection molding. The male housing 12 includes one or more male blade terminals 28 and can include one or more alignment features 14, such as longitudinal extending rails or ledges to insert into complementary openings of the female housing 52 of the female connector 50.

The male housing 12 also includes one or more retention features 16 on an outer surface of the male housing 12. The retention features 16 are configured to resiliently deform a portion of the female housing 52 of the female connector 50 when the male housing 12 is initially inserted into the female housing 52. The retention features 16 include a ramped first surface 18 and a ramped second surface 20. When the male housing 12 is inserted into the female housing 52, the ramped first surface 18 causes a portion of the female housing 52 having a retention opening 54 with a retention ledge 56 to resiliently deform until the retention features 16 are within the retention opening 54. The female housing 52 returns to its original shape to substantially prevent the male housing 12 from inadvertently disconnecting from the female housing 52 through the interaction of the retention features 16 with the retention ledge 56 of the female housing 52. The retention opening 54 extends along a length of the female housing 52 such that the retention features 16 can slide within the retention opening 54 as the male blade terminal protector 30 is moved from the extended position to the retracted position and one or more male blade terminals 28 electrically couple to the one or more female terminals 58, as will be described in greater detail herein. In some implementations, the male housing 12 may resiliently deform until the retention features 16 are within the retention opening 54.

When the male housing 12 is to be disconnected from the female housing 52, the ramped second surface 20 causes the portion of the female housing 52 having the retention opening 54 with the retention ledge 56 to resiliently deform until the retention features 16 are outside of the retention opening 54. Thus, the female connector 50 and male connector 10 can be completely disconnected. In some implementations, the male housing 12 may resiliently deform until the retention features 16 are outside of the retention opening 54.

The male housing 12 also includes a male blade terminal protector 30 shown positioned within the male housing 12 in an extended position such that one or more male blade terminals 28 (shown in FIG. 3) are positioned within one or more openings 32 (shown in FIG. 3) of the male blade terminal protector 30 and are covered by and do not extend out from the male blade terminal protector 30. Thus, the male blade terminal protector 30 covers the one or more male blade terminals 28 while the male connector 10 is disengaged from the female connector 50. The male blade terminal protector 30 can also be composed of a suitable electrically insulative material, such as a polymer, and can be manufactured through any suitable technique, such as injection molding. The male blade terminal protector 30 includes an outer face 34 through which the one or more openings 32 extend to allow the male blade terminals 28 to selectively extend through. The male blade terminal protector 30 also includes one or more body portions 36 extending from the outer face 34 and through which the one or more openings 32 also extend. The one or more body portions 36 may be sized to provide added support for the male blade terminals 28 when the male blade terminal protector 30 is both in the extended position and the retracted position.

Figure 2:
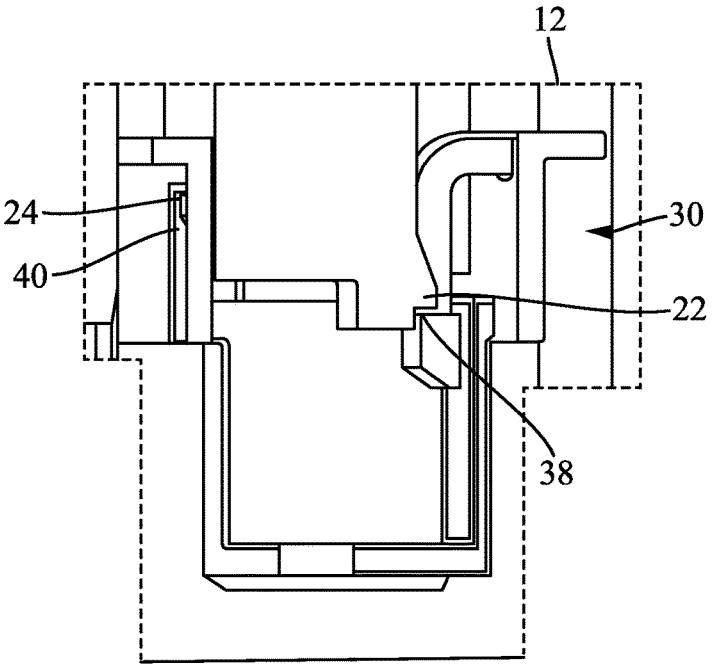
FIG. 2 is a side cross-sectional view of a portion of the male connector taken along line 2-2 of FIG. 1 and showing the male blade terminal protector within a housing of the male connector.

Referring to FIG. 2, the male housing 12 includes a catch 22 that engages with a ledge 38 of the male blade terminal protector 30 to prevent and/or restrict the male blade terminal protector 30 from being moved longitudinally from the extended position to the retracted position. In addition, the male housing 12 includes a tab 24 positioned within a slot 40 of the male blade terminal protector 30 to prevent and/or restrict the male blade terminal protector 30 from being moved longitudinally outward and disconnected from the male housing 12. Thus, in the pre-set position, the male blade terminal protector 30 is cooperatively held from moving in the longitudinal direction by both the catch 22 interfacing with the ledge 38 and the tab 24 interfacing with the slot 40. The male blade terminal protector 30 is further prevented from moving laterally or vertically by the male housing 12. Accordingly, until the female connector 50 engages with the male connector 10, the male blade terminal protector 30 is held in the pre-set position to cover and protect the one or more male blade terminals 28.

Referring to FIG. 3, the female housing 52 of the female connector 50 is initially engaged with the male housing 12 of the male connector 10 by inserting the portion of the male housing 12 having the retention features 16 that resiliently deform the portion of the female housing 52 having a retention opening 54 via the ramped first surface 18 of the retention features 16. That is, the ramped first surface 18 of the retention features 16 engage with a retention ledge 56 to resiliently deform the portion of the female housing 52 until the retention features 16 are within the retention opening 54. The female housing 52 returns to its original shape to substantially prevent the male housing 12 from inadvertently disconnecting from the female housing 52 through the interaction of the retention features 16 with the retention ledge 56 of the female housing 52. In addition to the retention features 16 of the male housing 12 engaging with the retention ledges 56 of the female housing 52 to couple the female connector 50 to the male connector 10, a face 60 of the female housing 52 contacts the outer face 34 of the male blade terminal protector 30.

Figure 4:
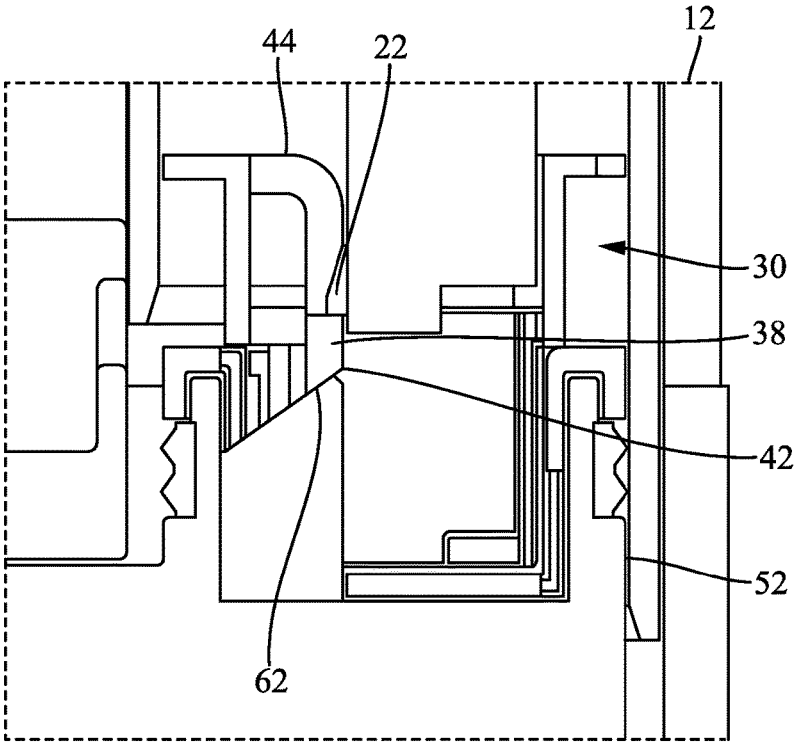
FIG. 4 is a side cross-sectional view of a portion of the male connector taken along line 4-4 of FIG. 3 and showing the housing of the female connector abutting a portion of the male blade terminal protector.

As shown in FIG. 4, a ramped surface 62 of the female housing 52 contacts a complementary ramped surface 42 of the ledge 38 of the male blade terminal protector 30. As the female connector 50 is pushed longitudinally to connect to the male connector 10, the ramped surface 62 of the female housing 52 resiliently deforms a support arm 44 connected to and supporting the complementary ramped surface 42 of the ledge 38 such that the ledge 38 is pushed up and over the catch 22 of the male housing 12, thereby allowing the male blade terminal protector 30 to be moved in the longitudinal direction from the extended position to the retracted position. As the female connector 50 is moved longitudinally relative to the male connector 10, the tab 24 of the male housing 12 (shown in FIG. 2) slides within the slot 40 of the male blade terminal protector 30. Thus, the one or more male blade terminals 28 are covered and protected by the male blade terminal protector 30 when the male blade terminal protector 30 is in the extended position and the female connector 50 is not engaged with the male connector 10, and the female housing 52 covers and protects the one or more male blade terminals 28 as the female connector 50 is engaged with the male connector 10.

As shown in FIG. 5, the female housing 52 further includes a retraction tab 64 that also resiliently deforms a portion of the male blade terminal protector 30 that includes a retraction opening 46. As the female connector 50 is coupled to the male connector 10, the retraction tab 64 having a first ramped surface 66 contacts the portion of the male blade terminal protector 30 that includes the retraction opening 46 until the retraction tab 64 inserts into the retraction opening 46. Once positioned in the retraction opening 46, the retraction tab 64 couples the female housing 52 to the male blade terminal protector 30 such that the male blade terminal protector 30 moves longitudinally with the female housing 52 while the female connector 50 is being connected and/or initially disconnected from the male connector 10.

Thus, when the female connector 50 is initially coupled to the male connector 10 the retention features 16 of the male housing 12 engage with the retention ledges 56 of the female housing 52 to restrict and/or prevent the male housing 12 from decoupling from the female housing 52, the ramped surface 62 of the female housing 52 contacts the complementary ramped surface 42 of the ledge 38 and resiliently deforms the support arm 44 connected to and supporting the complementary ramped surface 42 of the ledge 38 such that the ledge 38 is pushed up and over the catch 22 of the male housing 12 to allow the male blade terminal protector 30 to be moved in the longitudinal direction from the extended position to the retracted position, and the first ramped surface 66 of the retraction tab 64 contacts a portion of the male blade terminal protector 30 that includes the retraction opening 46 until the retraction tab 64 resiliently deforms the portion of the male blade terminal protector 30 for the retraction tab 64 to insert into the retraction opening 46. Accordingly, the male blade terminal protector 30 protects the male blade terminals 28 from external objects before and during coupling of the male connector 10 to the female connector 50.

Referring to FIG. 6, as the female connector 50 is moved longitudinally relative to the male connector 10, the male blade terminal protector 30 is moved longitudinally with the female housing 52 relative to the male housing 12 of the male connector 10 from the extended position to the retracted position shown in FIG. 6. Thus, the male blade terminals 28 extend out through the one or more openings 32 formed through the male blade terminal protector 30 to electrically couple to the one or more female terminals 58. In addition, the retention features 16 of the male housing 12 slide within the retention opening 54 of the female housing 52 as the male blade terminal protector 30 is moved from the extended position to the retracted position.

When the male connector 10 and the female connector 50 are to be unmated, the female housing 52 is moved longitudinally away from the male housing 12. During the longitudinal movement of the female housing 52 away from the male housing 12, a second ramped surface 68 of the retraction tab 64 contacts the portion of the male blade terminal protector 30 that includes the retraction opening 46 to pull the male blade terminal protector 30 with the female housing 52 relative to the male housing 12. Thus, the male blade terminal protector 30 is longitudinally moved from the retracted position to the extended position shown in FIG. 3 from the engagement of the retraction tab 64 in the retraction opening 46 of the male blade terminal protector 30. Accordingly, the male blade terminal protector 30 protects the male blade terminals 28 from external objects during decoupling of the male connector 10 to the female connector 50.

In addition to the retraction tab 64 engaging the male blade terminal protector 30 via the retraction opening 46, the complementary ramped surface 42, shown in FIG. 4, of the ledge 38 contacts a ramped rear surface of the catch 22 to resiliently deform the support arm 44 connected to and supporting the complementary ramped surface 42 of the ledge 38 such that, once the ledge 38 longitudinally clears the front end of the catch 22, the ledge 38 returns to its original position to prevent and/or restrict the male blade terminal protector 30 from being moved longitudinally from the extended position to the retracted position. Furthermore, the tab 24, shown in FIG. 2, of the male housing 12 positioned within the slot 40 of the male blade terminal protector 30 contacts an end of the slot 40 to prevent and/or restrict the male blade terminal protector 30 from being moved longitudinally outward and disconnected from the male housing 12. As the female housing 52 is further longitudinally moved relative to the male housing 12, the tab 24 and slot 40 restrict the movement of the male blade terminal protector 30 relative to the female housing 52 such that the second ramped surface 68 of the retraction tab 64, shown in FIG. 5, contacts the portion of the male blade terminal protector 30 that includes the retraction opening 46 to resiliently deform the portion of the male blade terminal protector 30 to allow the retraction tab 64 to decouple from the retraction opening 46. Still further, as the female housing 52 is moved longitudinally relative to the male housing 12, the ramped second surface 20 of the retention features 16 contact the retention ledge 56 of the portion of the female housing 52 having the retention opening 54 to cause the portion of the female housing 52 to resiliently deform until the retention features 16 are outside of the retention opening 54. Once the retention features 16 are outside of the retention opening 54, the female connector 50 and male connector 10 are completely disconnected.

While this specification contains many specific implementation details, these should not be construed as limitations on the scope of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, the separation of various system components in the implementations described above should not be understood as requiring such separation in all implementations, and it should be understood that the described components and systems can generally be integrated in a single product or packaged into multiple products.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. Additionally, it is noted that limitations in the claims should not be interpreted as constituting "means plus function" limitations under the United States patent laws in the event that the term "means" is not used therein.

The terms "coupled," "connected," and the like as used herein mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another or with the two components or the two components and any additional intermediate components being attached to one another.

It is important to note that the construction and arrangement of the system shown in the various exemplary implementations is illustrative only and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A connector assembly comprising:

a male connector having a male housing, the male housing including:

one or more male blade terminals, a male blade terminal protector moveable from an extended position relative to the male housing to a retracted position relative to the male housing, the male blade terminal protector including one or more openings through which each of the one or more male blade terminals extend when the male blade terminal protector is in the retracted position, the male blade terminal protector covering the one or more male blade terminals when the male blade terminal protector is in the extended position, the male blade terminal protector including a ledge and a retraction opening, a catch engaging the ledge of the male blade terminal protector to restrict the male blade terminal protector from moving longitudinally relative to the male housing from the extended position to the retracted position; and a female connector configured to selectively engage with the male connector and having a female housing complementary to the male housing of the male connector, the female housing including:

one or more female terminals each configured to electrically couple to a corresponding male blade terminal of the one or more male blade terminals, a ramped surface configured to contact a surface of the ledge of the male blade terminal protector to disengage the ledge from the catch of the male housing when the female connector is coupled to the male connector, and a retraction tab configured to couple to the male blade terminal protector when the retraction tab inserts into the retraction opening of the male blade terminal protector;

wherein the male blade terminal protector is moveable from the extended position to the retracted position when the ledge is disengage from the catch by the ramped surface of the female housing; and wherein the retraction tab of the female housing is configured to move the male blade terminal protector from the retracted position to the extended position as the female connector is disengaged from the male connector.

2. The connector assembly of claim 1, wherein the ramped surface of the female housing resiliently deforms a support arm connected to and supporting the ledge such that the ledge is pushed up and over the catch of the male housing when the female connector is initially engaged with the male connector.

3. The connector assembly of claim 1, wherein the male housing includes a tab and the male blade terminal protector includes a slot, the tab engaging an end of the slot of the male blade terminal protector to restrict the male blade terminal protector from moving longitudinally away from the male housing beyond the retracted position.

4. The connector assembly of claim 1, wherein the male housing includes one or more retention features configured to resiliently deform a portion of the female housing of the female connector and insert into a retention opening of the female housing when the male housing is initially inserted into the female housing.

5. The connector assembly of claim 1, wherein the male housing includes one or more alignment features.

6. The connector assembly of claim 1, wherein the female housing covers the one or more male blade terminals when the male blade terminal protector is moved from the extended position to the retracted position.

7. The connector assembly of claim 1, wherein the male housing and the female housing comprise an electrically insulative material.

8. The connector assembly of claim 1, wherein the retraction tab is configured to resiliently deform a portion of the male blade terminal protector that includes the retraction opening for the retraction tab to insert into the retraction opening.

9. The connector assembly of claim 8, wherein the retraction tab includes a first ramped surface to contact and resiliently deform the portion of the male blade terminal protector to insert the retraction tab into the retraction opening when the female connector is initially engaged with the male connector.

10. The connector assembly of claim 9, wherein the retraction tab includes a second ramped surface to contact and resiliently deform the portion of the male blade terminal protector to decouple the retraction tab from the retraction opening when the female connector is disengaged from the male connector.

11. A connector assembly comprising:

a male connector having a male housing, the male housing including:

one or more male blade terminals, a male blade terminal protector moveable from an extended position relative to the male housing to a retracted position relative to the male housing, the male blade terminal protector covering the one or more male blade terminals when the male blade terminal protector is in the extended position, the male blade terminal protector including a ledge and a retraction opening, a catch engaging the ledge of the male blade terminal protector to restrict the male blade terminal protector from moving longitudinally relative to the male housing from the extended position to the retracted position; and a female connector configured to selectively engage with the male connector and having a female housing complementary to the male housing of the male connector, the female housing including:

one or more female terminals each configured to electrically couple to a corresponding male blade terminal of the one or more male blade terminals, a surface configured to contact the ledge of the male blade terminal protector to disengage the ledge from the catch of the male housing when the female connector is coupled to the male connector, and a retraction tab configured to couple to the male blade terminal protector when the retraction tab inserts into the retraction opening of the male blade terminal protector;

wherein the male blade terminal protector is moveable from the extended position to the retracted position when the ledge is disengage from the catch by the surface of the female housing; and wherein the retraction tab of the female housing is configured to move the male blade terminal protector from the retracted position to the extended position as the female connector is disengaged from the male connector.

12. The connector assembly of claim 11, wherein the ramped surface of the female housing resiliently deforms a support arm connected to and supporting the ledge such that the ledge is pushed up and over the catch of the male housing when the female connector is initially engaged with the male connector.

13. The connector assembly of claim 11, wherein the male housing includes a tab and the male blade terminal protector includes a slot, the tab engaging an end of the slot of the male blade terminal protector to restrict the male blade terminal protector from moving longitudinally away from the male housing beyond the retracted position.

14. The connector assembly of claim 11, wherein the male housing includes one or more alignment features.

15. The connector assembly of claim 11, wherein the retraction tab includes a first ramped surface to contact and resiliently deform a portion of the male blade terminal protector to insert the retraction tab into the retraction opening when the female connector is initially engaged with the male connector.

16. The connector assembly of claim 15, wherein the retraction tab includes a second ramped surface to contact and resiliently deform the portion of the male blade terminal protector to decouple the retraction tab from the retraction opening when the female connector is disengaged from the male connector.

17. A connector comprising:

a male housing;

one or more male blade terminals;

a male blade terminal protector moveable from an extended position relative to the male housing to a retracted position relative to the male housing, the male blade terminal protector including one or more openings through which each of the one or more male blade terminals extend when the male blade terminal protector is in the retracted position, the male blade terminal protector covering the one or more male blade terminals when the male blade terminal protector is in the extended position, the male blade terminal protector including a ledge and a retraction opening; and a catch engaging the ledge of the male blade terminal protector to restrict the male blade terminal protector from moving longitudinally relative to the male housing from the extended position to the retracted position;

wherein the male blade terminal protector is moveable from the extended position to the retracted position when the ledge is disengage from the catch by a surface of a female housing when a female connector is initially engaged with the connector; and wherein a retraction tab of the female housing is configured to couple to and move the male blade terminal protector from the retracted position to the extended position as the female connector is disengaged from the connector.

18. The connector of claim 17, wherein a support arm connected to and supporting the ledge is resiliently deformed by the surface of the female housing such that the ledge is pushed up and over the catch of the male housing when the female connector is initially engaged with the male connector.

19. The connector of claim 17, wherein a portion of the male blade terminal protector is resiliently deformed by a first ramped surface of the retraction tab to insert the retraction tab into a retraction opening formed in the male blade terminal protector when the female connector is initially engaged with the connector.

20. The connector of claim 19, wherein the portion of the male blade terminal protector is resiliently deformed by a second ramped surface of the retraction tab to decouple the retraction tab from the retraction opening when the female connector is disengaged from the connector.

* * * * *